United States Patent [19]

Saunders

[11] 3,956,915

[45] May 18, 1976

[54] DRAWING AND IRONING CONTAINER STOCK AND MANUFACTURING METHODS

[75] Inventor: William T. Saunders, Weirton, W. Va.

[73] Assignee: National Steel Corporation, Pittsburgh, Pa.

[22] Filed: Mar. 25, 1975

[21] Appl. No.: 561,832

[52] U.S. Cl. ..... 72/198; 72/41; 72/366; 72/199

[51] Int. Cl.[2] ..... B21B 27/02

[58] Field of Search ..... 72/198, 197, 366, 199, 72/41, 46, 236; 29/148.4 D

[56] References Cited

UNITED STATES PATENTS

| | | | |
|---|---|---|---|
| 2,121,959 | 6/1938 | Frank | 72/409 |
| 3,145,468 | 8/1964 | Johnson | 72/366 X |
| 3,377,828 | 4/1968 | Harmon | 72/366 X |

*Primary Examiner*—Milton S. Mehr
*Attorney, Agent, or Firm*—Shanley, O'Neil and Baker

[57] ABSTRACT

Continuous-strip process for improving ironing operations in the manufacture of drawn and ironed container bodies having a bottom wall and unitary sidewall. Strip surfaces are treated, in final cold reduction operations for flat rolled container stock, to produce sculptured surfaces with fine line impressions to hold lubricant on the exterior surface of the sidewall during ironing and to reduce intimate surface contact with the ironing mandrel on the interior surface. Electroplated protective coatings are not reflowed in order to maintain the surface indentations.

7 Claims, 8 Drawing Figures

Figure 1:
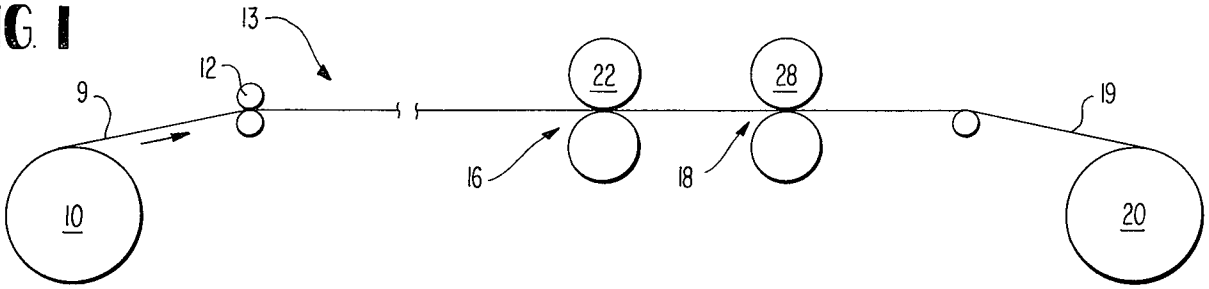

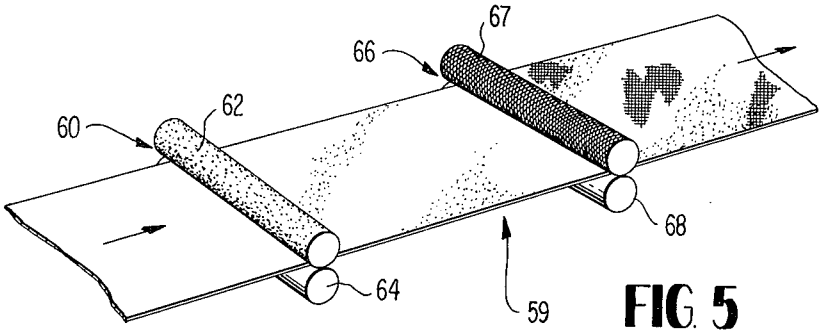
FIG. 5
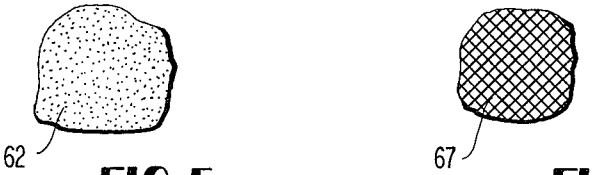
FIG. 5b
FIG. 5a
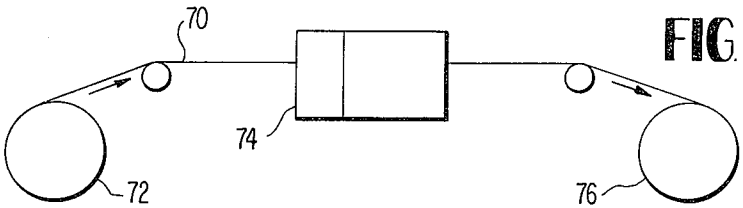
FIG. 6
FIG. 3
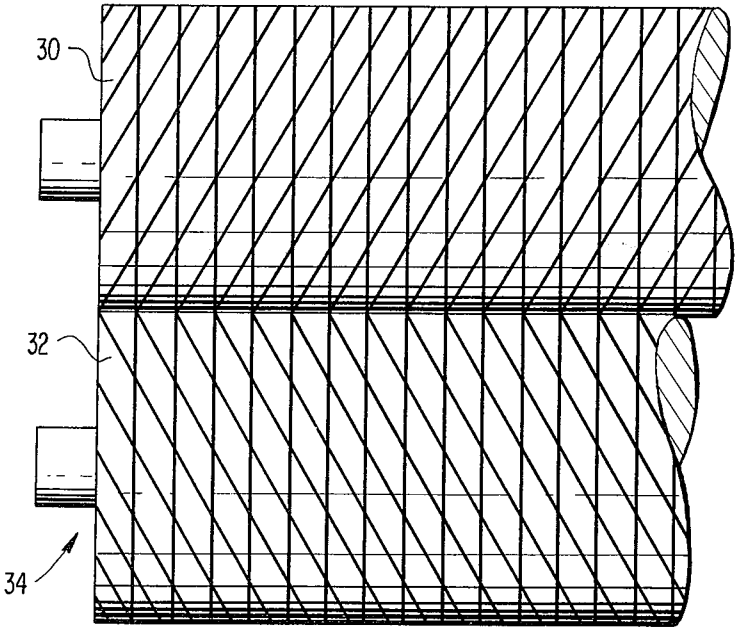
FIG. 4
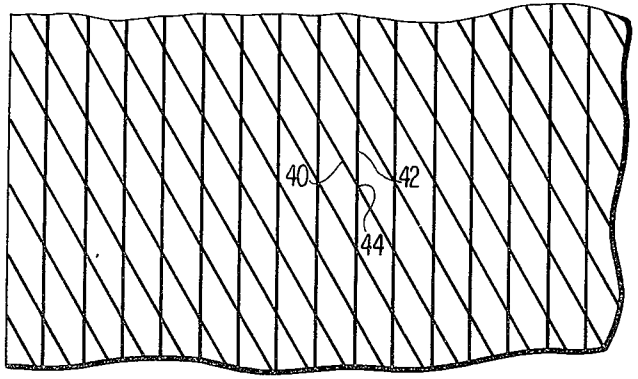

DRAWING AND IRONING CONTAINER STOCK AND MANUFACTURING METHODS

This invention is concerned with improved flat rolled sheet metal container stock and continuous strip methods for preparing flat rolled sheet metal for drawing and ironing operations to form cup-shaped, unitary, container bodies.

In drawing and ironing operations, a blank cut from flat rolled sheet metal is drawn into a cup with bottom wall and unitary sidewall. The cup sidewall is then reduced by ironing to form a container body with a bottom wall and elongated unitary sidewall. Methods and apparatus for carrying out drawing and ironing operation on flat rolled sheet metal, such as tinplated steel and aluminum, are known in the art; see e.g. U.S. Pat. Nos. 3,203,218 and 3,293,895.

In an ironing operation, a drawn cup, mounted on a mandrel, is passed sequentially, during a single stroke, through a series of ironing rings. The "ironing" action moves the metal along the sidewall, thinning and elongating such metal. For proper elongation purposes, the invention provides for positioning ironing lubricant between the sheet metal and each ironing ring as the metal is being worked by each ironing ring. It is postulated that contact with an ironing ring tends to move the surface lubricant ahead of the ring. In conventional practice, with this type of "squeegee" action on the lubricant in the first ironing ring, the metal tends to rip, crumple, or elongate unevenly during passage through subsequent ironing rings.

One prior attempt to solve problems associated with proper lubrication during drawing and ironing involves blasting the cold rolled steel, prior to ironing, with an abrasive to form pits or depressions in the surface of the metal (U.S. Pat. No. 3,670,543). Use of soft metal coatings which act as a lubricant has also been advanced as a possible solution.

The present invention provides a solution applicable to any of the usual sheet metal container stocks, including uncoated flat rolled steel, and, a solution which can be carried out during continuous-strip production without the post production handling or material costs of the prior art. Further, the invention provides practicable solutions to ironing problems in addition to outer surface lubrication.

Another problem in the manufacture of drawn and ironed containers recognized in the present invention involves the build-up of surface adhesion between the ironing mandrel and the interior sidewall of the container body. This surface adhesion problem is the result of the intimate surface contact developed between the mandrel and the inner surface of the sidewall as that sidewall is thinned and elongated by ironing. The result is difficulty in removing the ironed container from the mandrel causing a slowdown in operations and/or damage to product. The treatment of the present invention is an aid in decreasing this surface adhesion and, therefore, helps alleviate ironed-container removal problems.

The difficulties associated with drawing and ironing are more pronounced with harder metals such as flat rolled steel, especially double-reduced thin-gage container stock and the hard or semi-hard steels of higher tensile strengths currently being developed for container uses. The invention improves the drawing and ironing capabilities of such flat rolled steel in the uncoated state (blackplate), as well as those of steels having harder coatings resulting from chromium treatments or treatments which do not have the lubricating properties of tin or other soft metal coatings. Such difficult-to-iron sheet metal stocks will be considered specifically without, however, detracting from the contributions of the invention for softer metal container stocks, such as flat rolled aluminum, and soft metal coated steel stock, such as tinplate.

Part of the invention is the provision of unconventional surface finishes which will improve lubricant adhesion on the exterior surface of the sidewall of a cup during ironing and decrease the intimate surface contact with the ironing mandrel on the interior surface. The in-line processing features, which do not add handling steps after production, nor material costs such as coating costs and the like, are part of the significant advantages of the invention.

The production of double-reduced container stock is a representative example of the in-line processing of the present invention. For many years, conventional flat rolled steel stock was processed to permit a single cold reduction operation to prepare material for tinplating with a weight around one hundred pounds per base box; roughly 0.010–0.012 in. (0.25–0.3 mm) in thickness gage. With double cold reduction operations, suitable container stock between about forty-five and one hundred pounds per base box, roughly 0.005–0.011 in. (0.12–0.23 mm) thickness gage, can be produced. The invention utilizes portions of the final cold reduction processing to impart a textured surface finish. The resulting in-line processed, continuous-strip product of the invention is then suitable for drawing and ironing operations without subsequent modifications.

Figure 2:
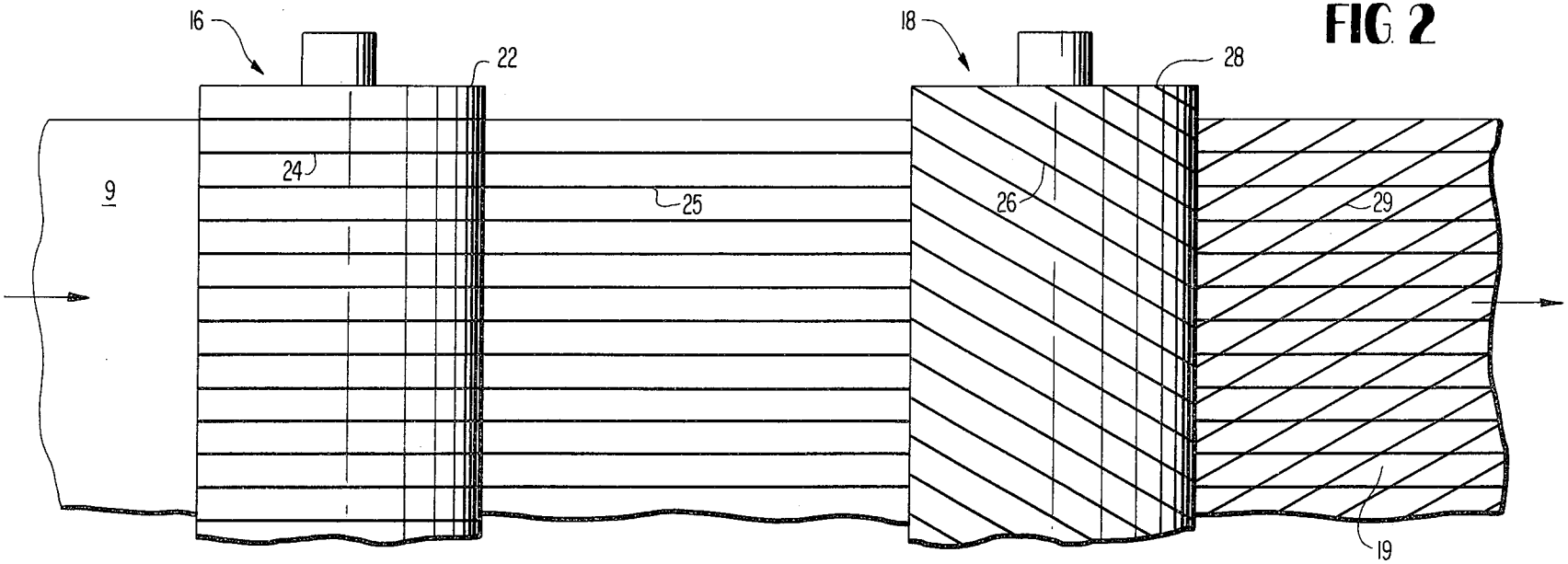

Typical apparatus and resulting product are shown schematically in the accompanying drawings. In these drawings:

FIG. 1 is a schematic view, in side elevation, of a continuous-strip processing line utilized in the present invention, FIG. 2 is a plan view of a portion of FIG. 1 showing surface contact rolls forming part of the present invention, FIG. 3 shows a portion of the surface contact rolls of a single roll stand treatment of the present invention, FIG. 4 shows a portion of a continuous-strip surface treated in accordance with the present invention, FIG. 5 is a perspective schematic view of continuous processing line means embodying the invention with portions of the surface contact rolls shown enlarged in FIGS. 5*a* and 5*b*, and FIG. 6 is a schematic view, in side elevation, of plating line means for use with the present invention.

In FIG. 1, continuous-strip 9 is fed from coil 10 into feed roll stand 12 of continuous processing line 13. The invention is carried out in the final stages of the processing. For example in the double reduction of flat rolled steel container stock, the sheet metal is treated in the final cold reducing operations. As shown in FIG. 1, these final operations would utilize roll stands 16 and 18. From these roll stands continuous-strip 19, which has been surface treated, is wound into coil 20 for shipment either as blackplate or to electroplating processing lines.

In accordance with the invention, the finish of the surface contacting rolls in the final operations is preselected to impart a sculptured or texturized finish on strip surfaces which will enhance lubricant adhesion on the exterior surface of a container being ironed and decrease intimate surface contact with the ironing mandrel on the interior surface. Multiple fine line impressions are an important part of the desired pattern. Intersections of the fine line impressions also establish a pattern of discrete recesses.

A first set of fine lines can be impressed on the surface of the continuous-strip in a direction parallel to the direction of rolling and, a second set of fine lines impressed in transverse relationship to the direction of rolling. Other combinations of impressions can be used to carry out the teachings of the invention; e.g. with selected roll surface finishes suitable intersecting lines can be impressed in a single roll stand operation.

Referring to FIG. 2 for consideration of some typical preselected roll finishes, roll 22 of roll stand 16 has a surface finish with a series of linearly extended raised portions, embossing lines 24, which extend around the surface of roll 22. These raised portions 24 of the roll surface rise about 0.02 to 0.15 mils in height above the remaining finish surface of the roll; spacing between embossments should be held to a practical minimum while obtaining the maximum number of lines possible within the physical limitations of cutting the rolls and making impressions. Included in these physical limitations is maintaining the strength of cut portions and maintaining tool life. A typical spacing would be on the order of 1/64 in. to ⅛ in. to provide sufficient lubricant for ironing a typical twelve ounce beverage container. Such roll surface embossments impress parallel lines 25 of about 0.04 mils in depth into the continuous strip surface.

In the roll stand 18, raised portions 26 extend helically about roll 28 and are angled in a direction transverse to the direction of rolling. The surface embossments 26 also protrude about 0.02 to 0.15 mils above the remainder of the surface finish of the roll and are spaced as described immediately above. Passage through roll stand 18 causes linear impressions 29 which are in transverse relationship to those (25) first impressed by passage through roll stand 16. The resulting pattern on the strip is a fine line pattern with linear impression depths selected, e.g. about 0.04 mils and intersections of fine line impressions having depths about 0.04 mils and higher. Both the fine line impressions and the intersections act as reservoirs for lubricant on the exterior surface of the container body during its early ironing stages, with the depth of the intersections acting to hold sufficient lubricant for the final ironing stage. This pattern is impressed on both surfaces of the strip with the bottom rolls of roll stands 16 and 18 being simlar to rolls shown in FIG. 2.

FIG. 3 shows the pattern on the surfaces of rolls 30, 32 in a single roll stand 34. Treatment in roll stand 34 forms intersecting lines of desired depth, approximately 0.04 mils. A typical pattern resulting from single roll stand 34 is shown in FIG. 4. Intersecting lines such as 40 and 42 form the depression 44 which can have a depth of 0.04 mils and higher.

The invention departs from typical finishing operations in preparing container stock. Long established finishing mill practice has been to use finishing rolls having the same finish, e.g. a ground finish, to produce a continuous smooth surface on the container stock. With the differing roll treatments of the present invention a textured or sculptured surface is produced. Such surface, confronting the ironing rings will hold lubricant. The texturing or sculpturing of the strip surface can be uniformly repetitious with lines of the pattern closely spaced on the strip surface so as to hold sufficient lubricant for passage through more than one ironing ring as required.

The fine line impressions described can advantageously be combined with a sand blasted roll finish. Referring to the temper mill line 59 of FIG. 5, a first roll stand 60 includes rolls 62, 64 with a preselected finish achieved by blasting the roll surface with an abrasive. A subsequent roll stand 66, includes rolls with an intersecting line pattern similar to that shown in FIG. 3. With this processing, the abrasive blasting roll treatment imparts a roughened grit finish to the continuous-strip surface. Lubricant held by this rough finish is moved during ironing, primarily during passage through the first ironing ring, to fill reservoirs created by the fine line impressions for subsequent ironing operations.

Also, by selective coating the desired depth is maintained during coating of, e.g., flat rolled steel (blackplate). Coating application is limited to an electroplating or the like type of plating which will maintain surface impressions. Typical electroplating operations would include electro-tinplate or chromic treatment of steel.

Referring to FIG. 6, continuous-strip 70 which in the final operations of its processing was given a surface finishing treatment, as earlier described, is then fed from roll 72 into plating means 74 and coiled at wind-up roll 76. Electroplating, without reflow of the coating, will follow the contours and desired surface impressions for subsequent drawing and ironing operations are maintained. Typical tinplate coating up to about 1.5 number/bb or about 0.15 mil in thickness can be utilized, while avoiding reflow. Continuous-strip electro-tinplating processes and apparatus are well known in the art, e.g. see U.S. Pat. No. Re. 23,456.

The above disclosure of methods and means for in-line processing to improve drawing and ironing operations provides the necessary background and teachings for other combinations for carrying out the invention. Modifications of roll finishes, combinations of roll finish treatments, materials, and timing of treatment can be made without departing from the principles of the invention so that the scope of the invention is to be determined from the appended claims.

What is claimed is:

1. In the production of flat rolled sheet metal for use in manufacture of a drawn and ironed cup-shaped container body having a bottom wall and a unitary sidewall, a continuous-strip method for improving lubricant adhesion to one surface of such strip material and decreasing surface contact on the remaining surface during subsequent drawing and ironing operations, comprising the steps of providing flat rolled sheet metal in continuous-strip form, processing such continuous-strip to selected gage by cold rolling in continuous-strip rolling mill means including performing final cold reducing operations to impart a selected surface texture, such final cold reducing operations including the steps of providing roll stand means with surface contact rolls of preselected embossed finishes, and passing the continuous-strip through such roll stand means to impart a pattern of surface indentations on such continuous-strip surfaces, such surface indentations including linearly extended impressions providing a textured surface for holding lubricant on that surface of the continuous-strip to be exposed to ironing rings working on an exterior surface of a cup drawn from such continuous-strip, with the remaining surface of the continuous-strip flat rolled sheet metal being treated simultaneously during passage through such roll stand means to imprint surface indentations including linearly extended impressions for decreasing intimate surface contact between an ironing mandrel and such remaining surface during ironing operation on such cup.

2. The method of claim 1 in which the roll stand means comprise tandem roll stands and the preselected finish on the surface contact rolls in each roll stand differs substantially.

3. The method of claim 1 in which such continuous-strip comprises flat rolled steel and the desired surface texture is imparted in a double-reduction mill producing container stock having a thickness gage between about 0.005 inch and about 0.011 inch.

4. The method of claim 1 in which the continuous-strip comprises flat rolled steel and the surface indentations are imparted in a tandem coil temper mill having at least two roll stands with linearly extended impressions being formed in one roll stand and linearly extended impressions in transverse relationship thereto being formed in a subsequent roll stand such that intersections of such linearly extended impressions result in indentations of at least 0.04 mils depth.

5. The method of claim 1 in which the surface contact roll means include linearly extended embossing lines which impart a plurality of linearly extended impressions forming such pattern of surface indentations having a depth of about 0.04 mils.

6. The method of claim 5 in which such pattern of surface indentations extends across substantially the full width of such continuous-strip and is uniformly repetitious in the direction of rolling along the length of such continuous-strip, such linearly extended impressions being in substantially parallel relationship and spaced from each other about 1/64 inch to ⅛ inch.

7. The method of claim 1 in which the roll stand means include at least two roll stands in tandem with the surface contact roll means of at least one roll stand imparting a grit finish to the continuous-strip surfaces.

* * * * *